US005944579A

United States Patent [19]

Fleischman

[11] Patent Number: 5,944,579

[45] Date of Patent: Aug. 31, 1999

[54] NON-CONSTRICTING BRASSIERE

[76] Inventor: Marcia C. Fleischman, 9605 Manor Rd., Leawood, Kans. 66206

[21] Appl. No.: 08/890,280

[22] Filed: Jul. 9, 1997

Related U.S. Application Data

[63] Continuation of application No. 08/542,533, Oct. 13, 1995, abandoned.

[51] Int. Cl.[6] ..... A41C 3/00; A41B 9/00

[52] U.S. Cl. ..... 450/69; 2/73

[58] Field of Search ..... 450/1–40, 69, 450/70, 71, 72, 58, 74–79, 80, 81, 82, 83, 84, 85; 2/73, 105, 106, 115, 113, 114

[56] References Cited

U.S. PATENT DOCUMENTS

| | | | |
|---|---|---|---|
| D. 321,083 | 10/1991 | Thygesen | D2/24 |
| 647,154 | 4/1900 | Phillips | D2/24 |
| 1,276,266 | 8/1918 | Querns | D2/24 |
| 1,434,944 | 11/1922 | Cooper | D2/24 |
| 2,375,070 | 5/1945 | Bloom . | |
| 2,421,955 | 6/1947 | McAbee . | |
| 2,707,284 | 5/1955 | Artzt | D2/24 |
| 3,430,632 | 3/1969 | James et al. . | |
| 3,467,105 | 9/1969 | White . | |
| 3,525,341 | 8/1970 | Guberman . | |
| 3,537,279 | 11/1970 | Epley | 66/176 |
| 3,628,539 | 12/1971 | Fredricks | 128/427 |
| 3,718,143 | 2/1973 | Pagano | 128/499 |
| 4,174,717 | 11/1979 | Schreiber | 128/494 |
| 4,289,137 | 9/1981 | Dell | 128/482 |
| 4,311,150 | 1/1982 | Schreiber | 128/494 |
| 4,341,219 | 7/1982 | Kuznetz | 128/498 |
| 4,510,626 | 4/1985 | Bowditch | 2/115 |
| 4,531,525 | 7/1985 | Richards . | |
| 4,538,614 | 9/1985 | Henderson | 128/494 |
| 4,583,544 | 4/1986 | Flanagan | 128/482 |
| 4,816,005 | 3/1989 | Braaten | 450/58 |
| 4,909,771 | 3/1990 | Bergman | 450/3 |
| 4,957,466 | 9/1990 | Hopps | 450/85 |
| 5,119,511 | 6/1992 | Packer et al. . | |
| 5,167,566 | 12/1992 | Novitsky | 450/74 |
| 5,211,598 | 5/1993 | Hall | 450/1 |
| 5,461,725 | 10/1995 | Witczak . | |
| 5,553,468 | 9/1996 | Osborne . | |

OTHER PUBLICATIONS

Jones Store Company Sales Flier dated approximately Oct. 1995.

J. Crew Catalog dated approximately Fall 1995.

Primary Layer Sale Catalog dated approximately Jan. 1996.

*Primary Examiner*—John J. Calvert

*Attorney, Agent, or Firm*—Sonnenschein, Nath and Rosenthal

[57] ABSTRACT

A non-constricting brassiere that provides limited support comprising a single piece of fabric having a front panel and a continuous rear panel with shoulder straps connected from said panels. The shoulder straps are a continuation of the material of the front and rear panels. The invention has neck and arm holes that are edged with lightweight elastic or aesthetically pleasing knitted trim. The front and rear panels are centrally connected at the front panel to form a seam, the seam having gathers. Affixed to the lower portion of the front and rear panels is a continuous sewn hem. The present invention does not use underwires, hardware, heavy elastic, binding or seaming in sensitive underarm or breast areas where lymph nodes are numerous, nor does it use such features so as to cause the wearer discomfort in the other areas of the body the bra contacts. The preferred bra provides only limited breast support so as to not adversely affect lymphatic circulation and to increase comfort.

15 Claims, 1 Drawing Sheet

NON-CONSTRICTING BRASSIERE

This application is a continuation of U.S. application No. 08/542,533 filed Oct. 13, 1995, now abandoned.

The present invention relates to a brassiere and, more particularly, to a non-constricting brassiere that provides limited breast support without constrictive binding, underwires, hardware, heavy elastic, boning or seams as found in the prior art.

Various types of brassieres have been constructed which are designed to be lightweight and give breast support. Many brassieres provide breast support utilizing constrictive materials and design that press the breasts and skin against the body with pressure causing redness, irritation and discomfort to the nipples, breasts, underneath the breasts, under the arms, and on the shoulders. Recently, some authorities have stated that traditional bra use, particularly those employing underwires, heavy elastic, cups, pads, bands and seams, press directly on a woman's lymphatic system in the breasts and surrounding area thereby preventing the lymphatic system from flushing the body of toxins that can accumulate in breast tissue and lead to breast cancer. See, e.g., Singer and Grismaijer, *Dressed to Kill: The Link Between Breast Cancer and Bras* (Avery 1995).

It will be appreciated from the foregoing that there is a definite need for a non-constricting brassiere that provides limited breast support without causing such redness, irritation, discomfort or inhibiting lymphatic circulation in the breasts or surrounding area.

SUMMARY

The present invention is directed to a brassiere that satisfies the need to have a brassiere that provides limited support and does not cause redness, irritation or discomfort or inhibit lymphatic circulation in the breast or surrounding area. The present invention provides a natural appearance and is for the health conscious woman. The present invention does not use underwires, hardware, heavy elastic, binding or seaming in sensitive underarm or breast areas where lymph nodes are numerous, nor does it use such features so as to cause the wearer discomfort in the other areas of the body the bra contacts.

A brassiere having features of the present invention comprises a single piece of fabric having a front panel and a continuous rear panel with shoulder straps connected from said panels. The shoulder straps are a continuation of the material of the front and rear panels. The invention has neck and arm holes that are edged with lightweight elastic or aesthetically pleasing knitted trim. The front and rear panels are centrally connected at the front panel to form a seam, the seam having gathers. Affixed to the lower portion of the front and rear panels is a continuous sewn hem.

Another object of the invention is to create form and add limited stability to the breasts while increasing comfort to the wearer so as to prevent redness, chafing, soreness, nipple irritation and edema caused by underwires, shoulder straps, cups, pads, heavy elastic, binding or side seams found in traditional and sports bras.

It is another object of the invention to provide a brassiere with limited support which is comfortable for use day or night. No cups are formed in the material and only one front gathered seam is employed to create form and provides minimal stability to the breasts. Because of the minimal breast support provided by the present invention, it is not intended to be used during exercise or if support is desired. It is not a sports bra.

The bra is made with a single layer of two-way stretch fabric that functions to provide minimal support to the breasts. Said fabric is aligned to create a greater horizontal stretch than vertical stretch which is designed to accommodate various breast sizes while lightly pulling the breasts vertically toward the chest. The wide shoulder straps also provide added support.

It is yet another object of the invention to provide a bra of low cost, one piece construction without hardware, heavy elastic, or side seams and with shoulder straps designed to avoid slipping off the shoulders. It is made of a breathable, perspiration resistant fabric which eliminates irritation.

The single sheet of fabric is laid flat and the front and rear panels with interconnectable shoulder straps are cut out as a mirror image of one another. The opposing cut shoulder straps are then aligned and attached to each other by stitching along respective adjacent side edges thereof.

The invention is easily used and may be donned by placing it over the head or by stepping into it and pulling it up over the body.

It is still another object of the invention to grip the wearer's torso so as to not ride up the rib cage to cause binding or discomfort.

In yet another aspect of the invention, the arm and neck holes are edged with lightweight elastic or knitted trim of various aesthetically pleasing materials to provide vertical support and prevent slippage of the shoulder straps and to shape and reinforce the garment. The arm holes are sufficiently wide to allow for comfort, ease of movement and are inconspicuous when the bra is worn with open-sleeved shirts. Further, the front and rear panels of the bra are designed and cut so that the shoulder straps sit on the wearer's shoulders some distance from the neck for added comfort and so that the straps are not visible under garments with large neck openings.

Other aspects and advantages of the present invention will become apparent from the following description of the preferred embodiment, taken in conjunction with the accompanying drawings, which illustrate the principles of the invention, it being understood that this embodiment is exemplary and not limitative.

DESCRIPTION

Figure 1:
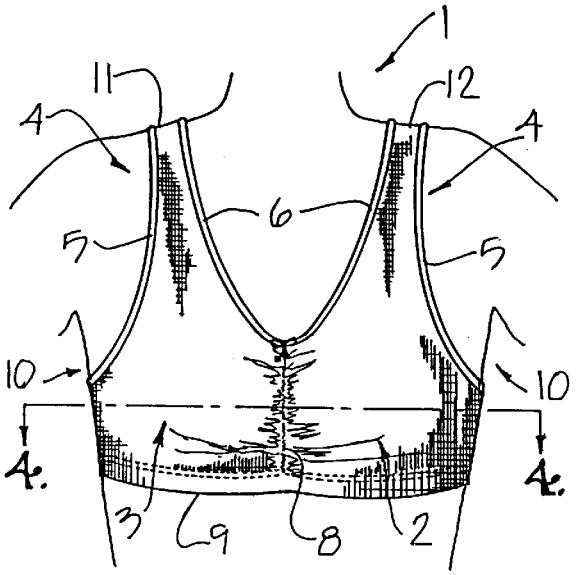
FIG. 1 is a front view of the embodiment of the invention as worn.

Referring to the accompanying drawings, a wearer 1 of the brassiere in accordance with the present invention 2 is shown in FIG. 1. As can be seen, the brassiere has a front panel 3 to which is attached, continuously, shoulder straps 4 which, in combination with the front panel, are edged with outer edging 5 and inner edging 6.

Figure 2:
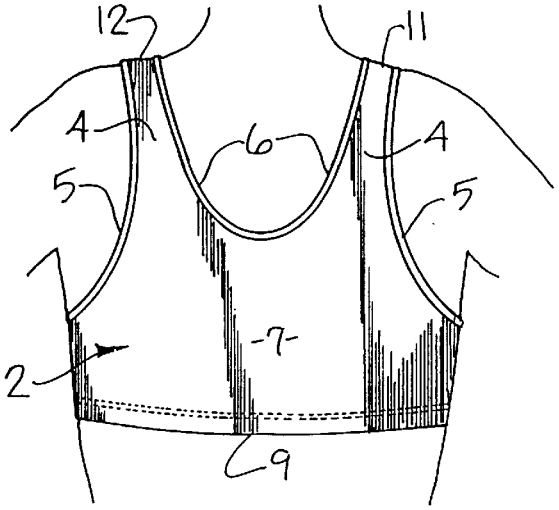
FIG. 2 is a rear view of the embodiment of the invention.
Figure 3:
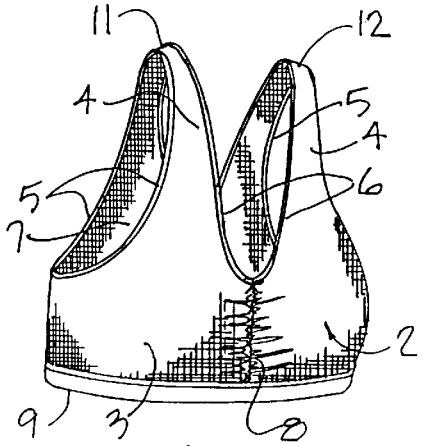
FIG. 3 is a perspective view of the embodiment of the invention.

As illustrated in FIGS. 1, 2, and 3, the brassiere has a continuous, uninterrupted rear panel 7 which is a continuation of front panel 3. Rear panel 7 is attached, continuously, to shoulder straps 4. Affixed to the lower portion of the front panel 3 and rear panel 7 is a continuous sewn hem 9. The front panel 3 and rear panel 7 are centrally connected at front panel 3 to form a gathered seam 8.

As previously indicated, the material from which front panel 3 and rear panel 7 of the brassiere are constructed is, generally, a two-way stretch fabric. The fabric is oriented so as to provide stretch that is from side to side as illustrated by the arrows A in FIG. 4. The side to side stretch accommodates for various breast sizes. Because of this two-way stretch, a small force, as illustrated by arrows B, is directed against the breasts to provide limited support. The gathered seam 8 is devoid of any stretch and provides a resistance point for the fabric. The gathers of gathered seam 8 are formed when front panel 3 and rear panel 7 are sewn together. Gathered seam 8 further provides horizontal and vertical breast support, strength and shaping to the garment and does not cause irritation to the wearer because of its location between the breasts. Gathered seam 8 resulting in two front halves does not contact the skin.

As may be clearly seen from FIGS. 1, 2, 3, and 4, the front panel 3 of the brassiere in accordance with the present invention has no cup forming members, underwires, hardware or heavy elastic bands. The front panel 3 provides a covering and pocket for the breasts, but the construction of the brassiere acts to provide limited and gentle support to the breasts rather than binding them against the body or molding or shaping them, all of which are actions which would lead to irritation, redness, chafing, and decreased lymphatic circulation.

Figure 4:
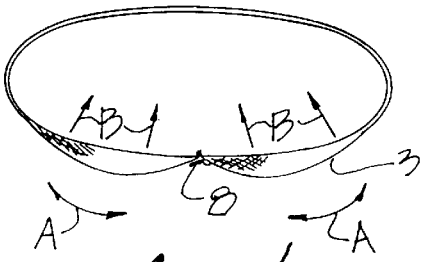
FIG. 4 is a cross section taken along lines 4–4 of FIG. 1.

As particularly illustrated in FIG. 4, the uninterrupted rear panel 7, which is a continuation of front panel 3, is substantially the same height as the height of the front panel 3. Since the rear panel 7 of the brassiere is a continuation of front panel 3, it is, obviously, formed of the same two-way stretch material and provides the same advantages as previously set forth. Rear panel 7 is devoid of any seams, hardware or elastic bands and, thus, provides additional comfort to the wearer. As illustrated in FIG. 1, the shoulder straps 4 provide vertical support to the breasts and their width further increases comfort and decreases slippage off the shoulders. Preferably, the shoulder straps 4 are 1 and ½ inches wide.

Each front and rear panel 3 and 7 is cut out with its shoulder straps 4 and the two portions are then connected together by strap seams 11 and 12.

The outer edging 5, which surrounds the arm openings, and inner edging 6, which surrounds the neck opening, further aid in providing limited vertical support to the breasts and to the garment generally. Edgings 5 and 6 further prevent slippage of the shoulder straps without causing redness or irritation of the skin. Edgings 5 and 6 are constructed of essentially continuous lightweight elastic or aesthetically pleasing knitted trim. Said elastic is affixed to the edges of shoulder straps 4 and is at least ⅜ inches wide and has a soft backing that prevents irritation and chafing when it contacts the skin. If knitted trim is employed instead of lightweight elastic, it may be of varying widths while maintaining the same function and comfort as the lightweight elastic.

The sewn hem 9 is located at the bottom front panel 3 and rear panel 7 and extends continuously around the bra. Sewn hem 9 finishes the lower edge of the garment, provides strength to the garment and aids in gripping the wearer's torso to prevent riding up of the garment. Sewn hem 9 is non-constricting and, therefore, does not irritate the wearer.

It will be noted that unlike conventional bras which have very little material below the cups, the bra according to the present invention includes substantial front and rear panels 3 and 7, respectively. These panels grip the torso and prevent the bra from riding up. Said panels are also designed so that the shoulder straps 4 sit away from the neck for added comfort and are inconspicuous under other garments.

For increased comfort and support, the underarm area is cut away to provide an arm hole as large as possible for comfort and freedom of movement but still leaves enough fabric at the side of the bra to provide lateral grip to further prevent riding up.

The main features of the illustrated bra which distinguish it from known bras are firstly that it is not a harness. It is specifically designed to provide limited breast support so as to not inhibit lymphatic circulation, cause redness or other discomfort. It is devoid of all hardware such as clips, hooks, buckles, constructional wiring, elastic bands, or plastic supports which can dig into the wearer and be a source of discomfort. Further, it is devoid of seams, darts or ventilation openings with their associated seams in the breast supporting area of front panel 3 so nipple or breast irritation is avoided. Additionally, the bra is distinct because it has no side seams and is thus more comfortable to the wearer.

Also, nylon is usually used in known bras and this material actually generates perspiration rather than absorbs it. By making the bra of the invention preferably out of cotton/Lycra*, ventilation openings are not needed as the cotton/Lycra* fabric absorbs perspiration and allows the skin to breathe naturally as it is only the cotton/Lycra* fabric which touches the skin. Alternatively, Antron Lycra* or stretch lace can be employed as the fabric of the invention which have the same general properties and function as cotton/Lycra*.

Because the bra is made of a flat piece of preferably cotton/Lycra or, alternatively, Antron Lycra* or stretch lace material, without clips, hooks, buckles, constructional wiring, plastic supports, boning, seams, darts, molding or other shaping, manufacture is made much easier and it is much more comfortable to wear as there is no need for additional cups or linings. The brassiere is donned by fitting it over the head and down onto the body. Alternatively, the brassiere may be stepped into and pulled up over the body.

The special design of the illustrated bra with its wide-apart shoulder straps means that it can readily be worn under most sleeveless garments, without the straps being visible. "Lycra" is DuPont's registered trademark for its elastane fibre. Although the use of trademarks is permissible in patent applications, the proprietary nature of the mark should be respected and every effort made to present their use in any manner which might adversely effect their validity as trademarks.

As indicated throughout this Application, the construction of the brassiere of the present invention is one which provides for the limited support of the breasts without the use of underwires, hardware, heavy elastic bands, boning or seams. The bra has no cups formed in the material and only one front gathered seam to connect the front and rear panels and to create form and add slight stability to the breasts. The brassiere is formed, essentially, as a continuous piece of fabric with one centrally joined gathered seam, and edgings of elastic members or knitted trim, which are provided for increased support and aesthetic value.

While specific embodiments of the invention have been shown and described, the invention should be considered as limited only as set forth in the appended claims.

I claim:

1. A non-constricting brassiere that provides limited breast support comprising:

a. a front panel having two front halves;

b. a continuous rear panel which is a continuation of said front panel, said rear panel having a height of substantially the same height of the front panel;

c. shoulder straps connecting said front panel and said rear panel, said shoulder straps being a continuation of said front and real panels;

d. a hem on said front and rear panels and extending continuously around said brassiere, said hem of a sufficient diameter so as to fit against the torso of the wearer without constricture and with a pressure approximately equal to the pressure against the other areas of a wearer's body in contact with the brassiere;

e. said front and rear panels and said shoulder straps being formed of a single piece of fabric which, without the use of underwires, heavy elastic, bands, hooks, clips, darts, cups, pads, boning, side seams, or ventilation holes, and, unlike sports or traditional bras, stretches over the breasts to provide limited breast support without causing the wearer redness, irritation, discomfort or decreased lymphatic circulation in the breasts and surrounding areas, said front and rear panels being of a sufficient length so that the hem extends substantially below the breasts and approximately onto the abdomen and lower back of the wearer; and f. a gathered seam connecting the two front halves of said front panel.

2. The brassiere of claim 1 wherein said front panel, said rear panel, and said shoulder straps are constructed of a two-way stretch fabric aligned so as to have a side to side stretch mode.

3. The brassiere of claim 1 wherein said front and rear panels are interconnected by said seam at the center of said front panel so as to be located between the breasts.

4. The brassiere of claim 1 wherein said brassiere is made of a single piece of said fabric.

5. The brassiere of claim 1 further comprising:

a. arm openings;

b. a neck opening;

c. a continuous lightweight elastic material surrounding said arm and neck openings.

6. The brassiere of claim 5 wherein said elastic material is at least ⅜ inches wide.

7. The brassiere of claim 1 wherein said shoulder straps are at least 1 inch wide.

8. The brassiere of claim 1 wherein said fabric is stretchable elastane fiber and cotton material.

9. The brassiere of claim 1 wherein said fabric is stretchable elastane fiber.

10. The brassiere of claim 1 wherein said fabric is stretch lace.

11. The brassiere of claim 1 wherein the shoulder straps being formed separately with the front and rear panels and being connected together by a respective shoulder strap seam.

12. The brassiere of claim 1 wherein the front and rear panels are designed and cut so that the shoulder straps sit on the wearer's shoulders some distance away from the wearer's neck.

13. The brassiere of claim 1 wherein the front and rear panels are of a width sufficient to prevent the bra from riding up on the wearer and causing discomfort.

14. The brassiere of claim 5 wherein said continuous lightweight elastic material is a knitted trim.

15. A non constricting brassiere which provides limited breast support without the use of underwires, heavy elastic, bands, books, clips, darts, cups, pads, bonding, side seams, or ventilation holes, comprising:

(a) a single piece of fabric having two breast portions, a rear panel, and two shoulder straps, each said shoulder extending from one said breast portion to said rear panel;

(b) said single piece of fabric being sewn together by three seams, said first and second seams located on each said shoulder strap and said third seam located vertically between the two said breast portions, said third seam creating a gather between said two breast portions, said three seams connecting said single piece of fabric to create one continuous circular piece of fabric; and (c) a hem on said front and rear panels and extending continuously around said fabric.

* * * * *